US005398384A

United States Patent [19]

Rinard

[11] Patent Number: 5,398,384

[45] Date of Patent: Mar. 21, 1995

[54] PAPER CLIP WITH WRITING SURFACES

[76] Inventor: Ernest W. Rinard, 5199 E. Pacific Coast Hwy., No. 322-N, Long Beach, Calif. 90804

[21] Appl. No.: 162,239

[22] Filed: Dec. 6, 1993

[51] Int. Cl.[6] ..... A44B 21/00; B42F 1/00

[52] U.S. Cl. ..... 24/67.9; 24/67 R

[58] Field of Search ..... 24/67.9, 67 R, 545, 24/546; 40/641

[56] References Cited

U.S. PATENT DOCUMENTS

| | | | |
|---|---|---|---|
| 1,897,755 | 2/1933 | Greene | 40/641 |
| 2,341,121 | 2/1944 | Schaaff | 24/67.9 |
| 2,938,252 | 5/1960 | Scheemaeker | 24/67.9 |
| 4,011,673 | 3/1977 | Levine | 24/67.9 |
| 4,914,791 | 4/1990 | Lorber | 24/67.9 |
| 5,010,629 | 4/1991 | Hirzel | 24/67.9 |
| 5,093,760 | 3/1992 | Bedol | 24/67.9 |

FOREIGN PATENT DOCUMENTS

| | | | |
|---|---|---|---|
| 1489764 | 7/1967 | France | 24/67.9 |
| 0613250 | 4/1935 | Germany | 24/67.9 |
| 0357374 | 11/1961 | Switzerland | 24/67.9 |
| 0360971 | 5/1962 | Switzerland | 24/67.9 |

*Primary Examiner*—Victor N. Sakran
*Attorney, Agent, or Firm*—Thomas I. Rozsa; Tony D. Chen

[57] ABSTRACT

The present invention is a novel and unique paper clip with writing surfaces on the front and back surfaces of the paper clip for writing notes. It has a flat body surrounded by an integrally connected frame which can be bent in a general arc for holding at least two papers between the flat body and the frame.

14 Claims, 1 Drawing Sheet

FIG. 1
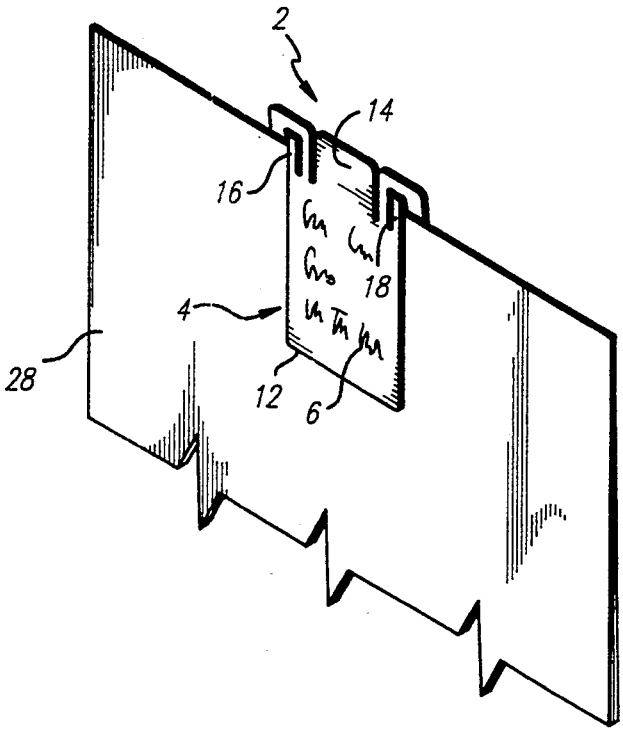
FIG. 2
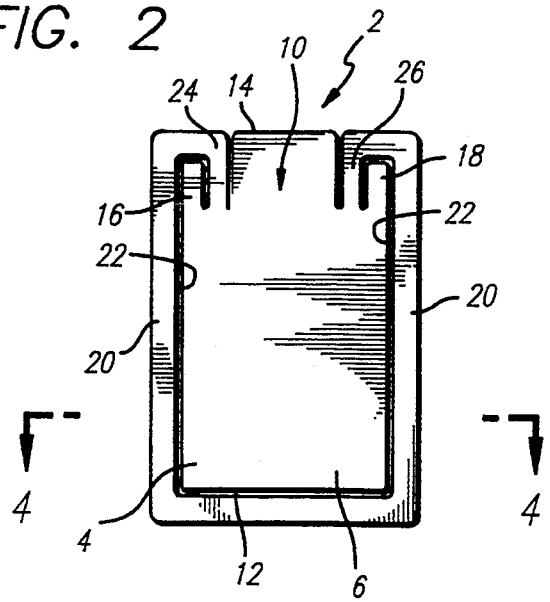
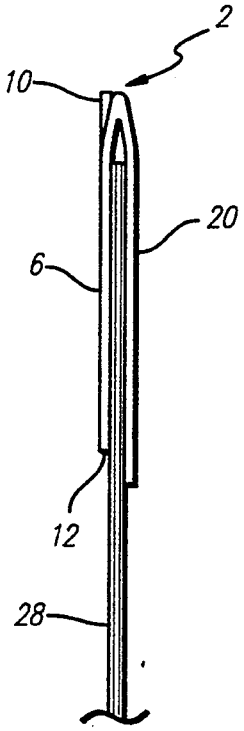
FIG. 3
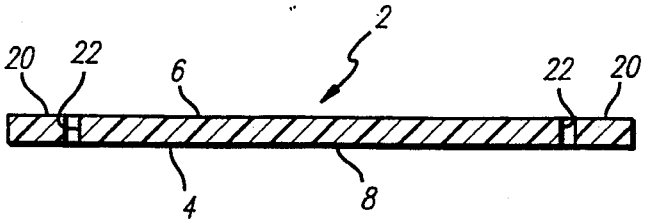
FIG. 4

PAPER CLIP WITH WRITING SURFACES

BACKGROUND OF THE INVENTION

1. Field of The Invention

The present invention relates to the field of stationery. More particularly, the present invention relates to the field of paper clips.

2. Description of The Prior Art

In general, various types of paper clips are known in the prior art and are in widespread use throughout society. Over the years, the conventional paper clips have changed from a simple metal design to exotic plastic paper clips and to elaborate binder clips. These paper clips come in all shapes and sizes for retaining together various quantities of papers. One of the disadvantages with the; prior art paper clips is that while they adequately serve to retain together a stack of papers, they do not have a writing surface on them for a person to write notes :on the paper clip. Another disadvantage is that while a self-stick removable note such as a "post-it-R" note pad can be used in conjunction with a paper clip for writing notes, the problem with this is that it is often too inconvenient to find the "post-it-R" note pad and place one of the self-stick removable notes onto the paper clipped papers. Another disadvantage with the self-stick removable note is that the adhesive bond can become loosened after time and the note can fall off.

Therefore, it is highly desirable to design a novel paper clip which includes flat writing surfaces for writing notes. It will be desirable to have a paper clip with writing surfaces so that a person can write notes on the paper clip without the need for a "post-it-R" note pad.

SUMMARY OF THE INVENTION

The present invention is a novel and unique paper clip with writing surfaces on the front and back surfaces of the paper clip for writing notes. The concept of the present invention is to have the paper clip made of acrylic resin in which the front and back surfaces of the paper clip are utilized for writing notes thereon.

It has been discovered, according to the present invention, that by utilizing a paper clip with writing surfaces, it will provide means for a person to write notes on the paper clip without using a "post-it-R" note pad.

It has further been discovered, according to the present invention, that by utilizing a paper clip made of plastic material or acrylic resin, the paper clip will retain its resiliency even when it serves to hold together a stack of papers. The outer thin frame will bend in a general arc to give the paper clip flexibility.

It is therefore an object of the present invention to provide a paper clip with writing surfaces so that a person can write notes on the paper clip without using a "post-it-R" note pad.

It is an additional object of the present invention to provide a paper clip made of acrylic resin so that the paper clip can retain its resiliency even when it holds a stack of papers together. The outer thin frame can be bent in a general arc to give the paper clip flexibility.

It is a further object of the present invention to provide a paper clip that is yellow in color because people will think of this as a writing surface if they see it in the color yellow.

The present invention paper clip with writing surfaces is not limited to the color yellow. The paper clip is preferably yellow in color, however the paper clip can have any other light colored surface so that a person can write on either the front surface or the back surface.

In general, the uniqueness of :the present invention is the writing surfaces on both the front and back surfaces of the paper clip. Another unique feature is that the paper clip retains its resiliency even when it serves to hold together a stack of papers. The outer thin frame can bend in a general arc to give the paper clip flexibility.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention paper clip which serves to retain together a stack of papers and wherein its front surface is utilized for writing notes.

FIG. 2 is a front elevational view of the present invention paper clip with a writing surface.

FIG. 3 is a side elevational view showing the present invention paper clip fastening pages together.

FIG. 4 is an enlarged cross-sectional view taken along line 4—4 of FIG. 2.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 and 4, there is shown a perspective view of the present invention paper clip 2 with writing surfaces thereon. The paper clip 2 serves to retain together a stack of twenty (20) or thirty (30) papers 28, as shown FIG. 1. The paper clip 2 has a generally rectangular shaped body 4 and an outer frame 20. The body 4 is defined as the solid rectangular portion and has a front surface 6, a back surface 8, a proximal end 10 which is the end of the solid flat surface, and a distal end 12. What is unique about the present invention paper clip 2 is that the front and back surfaces 6 and 8 are utilized for writing notes. In the preferred embodiment, both surfaces 6 and 8 are used for writing notes. However, at least one surface 6 or 8 is used for writing notes and the other surface may be used for purposes such as advertising. The paper clip 2 is also utilized to retain together a stack of papers 28, as illustrated in FIGS. 1 and 3.

The advantages of utilizing the present invention paper clip 2 is that a person does not have; to use a separate "post-it-R" note because the paper clip 2 provides the writing surfaces. The paper clip 2 eliminates the need for a "post-it-R" note pad. The person can simply write the note on the surface of the paper clip 2 such that the person does not need to have an extra "post-it-R" note that may fall off. The paper clip 2 will serve to bind everything together, and provides an immediate writing surface. The paper clip 2 will also serve as a visible signal for someone to observe because it is right at the top of the stack of papers 28 which is holding everything together. Another advantage is that the paper clip 2 can be utilized with either the front surface 6 or back surface 8 of the paper clip 2 for writing notes.

Another objective for the paper clip 2 is that the front surface 6 can be used as a business card while the back surface 8 can be used for writing notes. The paper clip 2 can be utilized in many ways. It will be appreciated that the present invention paper clip 2 is not limited to the above advantages as described.

Referring to FIG. 2, there is shown a front elevational view of the present invention paper clip 2. A flat wide tab 14 is located at the center of the proximal end 10 of the flat rectangular shaped body 4 such that it extends outwardly away from the flat body 4. A pair of opposite thin flat tabs 16 and 18 are also located at the proximal end 10 of the flat body 4 at opposite lateral locations such that the frames of the pair of thin flat tabs 16 and 18 are flush with the frames of the flat body 4.

A flexible outer thin frame 20 surrounds the flat body 4 (except at the location of the flat wide tab 14) and the pair of thin flat tabs 16 and 18 such that it forms a narrow slit 22 along their common circumferences. The flexible outer thin frame 20 has a first end 24 which is integrally attached to the proximal end 10 of the flat body 4 in-between the first thin flat tab 16 and the wide flat tab 14, and a second end 26 which is integrally attached to the proximal end 10 of the flat body 4 in-between the second thin flat tab 18 and the wide flat tab 14.

Referring to FIG. 3, there is shown a side elevational view of the present invention paper clip 2 which holds together a stack of paper 28. The uniqueness of the paper clip 2 is the fact that the outer thin frame 20 retains its resiliency even when it serves to hold together a stack of papers 28, as illustrated in FIG. 3. The outer thin frame 20 will bend in a general arc shape.

Referring to FIG. 4, there is shown a cross-sectional view of the present invention paper clip 2 which can be made from several materials. The manufacturing process which could accommodate the construction of the paper clip 2 can be injection, thermoform, etc. or other molding process. By way of example, the paper clip 2 can be made of acrylic resin material or plastic material with a multiplicity of colors.

The operation of the foregoing embodiment now will be described. The stack of papers 28 are retained together by inserting the papers 28 between the flat rectangular shaped body 4 and the flexible outer thin frame 20 such that the front surface 6 or back surface 8 is facing the user so that he or she can write a note thereon. The user can use one hand to separate the paper clip 2 by pressing the wide flat tab 14 with his or her thumb while the fingers are pressing the top ends of the outer thin flat frame 20 in a direction opposite to the thumb.

It will be appreciated that the paper clip 2 is not limited to the yellow color. It is emphasized that while the yellow color is preferred, it is also within the spirit and scope of the present invention to have a multiplicity of different colored paper clips.

It will also be appreciated that the present invention paper clip 2 is not limited to the rectangular shaped body 4. It is emphasized that while the rectangular shaped body 4 is preferred, it is also within the spirit and scope of the present invention have a multiplicity of configurations. In addition, it will not be too hard for one skilled in the art to change the shape of the paper clip. The different configurations of the paper clip 2 will give an attractive appearance.

The present invention has many advantageous features including: (a) it is inexpensive to manufacture; (b) either the front or back surface (or both surfaces) can be used to write a note; (c) it can be manufactured in a multiplicity of colors; and (d) the writing surfaces of the paper clip are erasable. If the note is intended to be erasable, it is written with a pencil. If the note is intended to be permanent, it is written with a pen.

Defined in detail, the present :invention is a paper clip for retaining together at least two papers, comprising: (a) a flat solid rectangular shaped body having a front surface, a back surface, a proximal end, and a distal end, where the front and back surfaces are used for writing notes thereon; (b) a wide flat tab integrally attached at a central location of said proximal end of said flat rectangular shaped body and extending outwardly away from said flat rectangular shaped body, the wide flat tab having opposite sides; (c) a first thin flat tab and a second thin flat tab, each thin flat tab integrally attached to said proximal end of :said flat rectangular shaped body and located at locations opposite to each other parallel to opposite sides of said wide flat tab; (d) a flexible outer thin frame surrounding said flat rectangular shaped body except for the portion of the rectangular shaped body attached to the wide flat tab, and also surrounding said first and second thin flat tabs such that the frame forms a narrow slit along the common circumference with the flat rectangular shaped body and first and second thin flat tabs, the frame having a first end and a second end, the first end integrally attached to said proximal end of said flat rectangular shaped body and between said first thin flat tab and said wide flat tab, and the second end integrally attached to said proximal end of said flat rectangular shaped body and between said second thin flat tab and said wide flat tab; and (e) said flexible outer thin frame can be bent in a general arc shape when said paper clip is retaining together said at least two papers; (f) whereby said at least two papers are retained together by inserting said at least two papers between said flat rectangular shaped body and said flexible outer thin frame such that said front surface or said back surface can be used for writing notes thereon.

Defined broadly, the present invention is a paper clip for retaining together at least two papers, comprising: (a) a flat rectangular body having a front surface, a back surface, a proximal end, and a distal end where at least one of the front surface or back surface is a writing surface; (b) a wide flat tab integrally attached to said proximal end of said flat rectangular body, the wide flat tab having two opposite sides; and (c) an outer thin frame surrounding a portion of said flat rectangular body such that it forms a slit along their common circumferences and having a first end integrally attached to said proximal end of said flat rectangular body and adjacent one side of said wide flat tab, and a second end integrally attached to said proximal end of said flat rectangular body and adjacent the opposite side of said wide flat tab; (d) whereby said at least two papers are retained together by inserting said at least two papers between said flat rectangular body and said outer thin frame such that at least one of said front surface or said back surface can be used for writing notes thereon.

Defined more broadly, the present invention is a paper clip for retaining together at least two papers, comprising: (a) a flat member having a front side, a back side, a top end, and a bottom end where at least one of the front side or the back side has a writing surface; and (b) an outer frame integrally attached to said top end of said flat member such that the outer frame surrounds a portion of said flat member and forming a slit along their common circumferences; (c) whereby said at least two papers are retained together by inserting the papers between said flat member and said outer frame such that said front side or said back side can be used for writing notes thereon.

Defined even more broadly, the invention is a paper clip, comprising: (a) a flat body surrounded by an integrally connected frame which is movable relative to the flat body and which can be bent in a general arc for holding at least two papers; and (b) said flat body having at least one surface on which words can be written.

Of course the present invention is not intended to be restricted to any particular form or arrangement, or any specific embodiment disclosed herein or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A paper clip for retaining together at least two papers, comprising:

a. a flat solid rectangular shaped body having a front surface, a back surface, a proximal end, and a distal end, where the front and back surfaces are for writing notes thereon;

b. a wide flat tab integrally attached at a central location of said proximal end of said flat rectangular shaped body and extending outwardly away from said flat rectangular shaped body, the wide flat tab having opposite sides;

c. a first thin flat tab and sa second thin flat tab, each thin flat tab integrally attached to said proximal end of said flat rectangular shaped body and located at locations opposite to each other parallel to opposite sides of said wide flat tab;

d. a flexible outer thin frame surrounding said flat rectangular shaped body except for the portion of the rectangular shaped body attached to the wide flat tab, and also surrounding said first and second thin flat tabs such that the frame forms a narrow slit along the common circumferences with the flat rectangular shaped body and first and second thin flat tabs, the frame having a first end and a second end, the first end integrally attached to said proximal end of said flat rectangular shaped body and between said first thin flat tab and said wide flat tab, and the second end integrally attached to said proximal end of said flat rectangular shaped body and between said second thin flat tab and said wide flat tab; and e. said flexible outer thin frame can be bent in a general arc shape when said paper clip is retaining together said at least two papers;

f. whereby said at least two papers are retained together by inserting said at least two papers between said flat rectangular shaped body and said flexible outer thin frame such that said front surface or said back surface can be used for writing notes thereon.

2. The invention as defined in claim 1 wherein said paper clip is made of acrylic resin material.

3. The invention as defined in claim 1 wherein said paper clip is yellow colored.

4. The invention as defined in claim 1 wherein said paper clip includes a multiplicity of colors.

5. A paper clip for retaining together at least two papers, comprising:

a. a flat rectangular body having a front surface, a back surface, a proximal end, and a distal end where at least one of the front surface or back surface is a writing surface;

b. a wide fiat tab integrally attached to said proximal end of said flat rectangular body and extending outwardly away from said flat rectangular body, the wide flat tab having opposite sides; and c. an outer thin frame surrounding a portion of said flat rectangular body except for said wide flat tab such that it forms a slit along their common circumferences and having a first end integrally attached to said proximal end of said flat rectangular body and adjacent one side of said wide flat tab, and a second end integrally attached to said proximal end of said flat rectangular body and adjacent the opposite side of said wide flat tab;

d. whereby said at least two papers are retained together by inserting the papers between said flat rectangular body and said outer thin frame such that at least one of said front surface or said back surface can be used for writing notes thereon.

6. The invention as defined in claim 5 wherein said paper clip is made of acrylic resin material.

7. The invention as defined in claim 5 wherein said paper clip is yellow colored.

8. The invention as defined in claim 5 wherein said paper clip includes a multiplicity of colors.

9. The invention as defined in claim 5 wherein said outer thin frame can be bent in a general arc shape when said paper clip is retaining together said at least two papers.

10. A paper clip for retaining together at least two papers, comprising:

a. a flat member having a front side, a back side, a top end, and a bottom end where at least one of the front side or the back side has a writing surface;

b. a wide tab integrally attached to said top end of said flat member and extending outwardly away from said flat member, the wide tab having opposite sides; and c. an outer frame integrally attached to said top end of said flat member such that the outer frame surrounds a portion of said flat member except for said wide tab and forming a slit along their common circumferences;

d. whereby said at least two papers are retained together by inserting said at least two papers between said flat member and said outer frame such that said front side on said back side can be used for writing notes thereon.

11. The invention as defined in claim 10 further comprising two narrow flat tabs, each narrow flat tab integrally attached to said top end of said flat member for providing stability.

12. The invention as defined in claim 10 wherein said paper clip is made of acrylic resin material.

13. The invention as defined in claim 10 wherein said paper clip is yellow colored.

14. The invention as defined in claim 10 wherein said paper clip includes a multiplicity of colors.

* * * * *